United States Patent [19]

Midlang et al.

[11] Patent Number: 4,966,004

[45] Date of Patent: Oct. 30, 1990

[54] ELECTRONIC CONTROL MOUNTING APPARATUS FOR REFRIGERATOR

[75] Inventors: Brian M. Midlang, Cedar Rapids; Bruce A. Kopf, Marion; Richard N. Walker, Victor, all of Iowa

[73] Assignee: Amana Refrigeration, Inc., Amana, Iowa

[21] Appl. No.: 432,438

[22] Filed: Nov. 6, 1989

[51] Int. Cl.[5] ..... F25B 49/02; H01H 13/06

[52] U.S. Cl. ..... 62/77; 62/125; 62/127; 62/298; 200/302.2; 236/94

[58] Field of Search ..... 62/125, 126, 127, 128, 62/129, 130, 131, 77, 298; 200/293, 296, 302.1, 302.2; 374/208; 235/145 R; 364/188, 189; 236/94

[56] References Cited

U.S. PATENT DOCUMENTS 4,235,368 11/1980 Neel ..... 236/94

4,404,813 9/1983 Paddock et al. ..... 62/127

4,791,258 12/1988 Youtz et al. ..... 200/302.1

*Primary Examiner*—Harry B. Tanner

*Attorney, Agent, or Firm*—William R. Clark; Richard M. Sharkansky

[57] ABSTRACT

An electronic control mounted in the door of a refrigerator. In fabrication, a compartment is formed within the refrigerated food door by positioning a tub behind a vertically elongated aperture near the edge of the door, and inserting locator pins of the tub through corresponding holes in the door panel so as to provide alignment between the two. The trim mounting bracket also has holes aligned to receive the locator pins, and the trim mounting bracket is screwed through the door panel to the tub. The control board is inserted into the compartment through the aperture and mounted to the tub. A plate is mounted over the aperture and provides a flame barrier in addition to having a side lever that reenforces the portion of the panel peripheral to the aperture so as to prevent oil canning. Finally, the decorative trim which integrally includes a control panel is positioned over the plate and mounted to the trim mounting bracket. The control panel and plate have windows that self-align with the visual display of the control board.

16 Claims, 6 Drawing Sheets

ELECTRONIC CONTROL MOUNTING APPARATUS FOR REFRIGERATOR

BACKGROUND OF THE INVENTION

The field of the invention generally relates to an electronic control for a refrigerator, and more particularly relates to apparatus and method for mounting the electronic control board in the door of a refrigerator.

Refrigerators have been made to include electronic controls. Generally, these controls have a microprocessor on a circuit control board with remote sensors such as door opening switches and thermal sensors that monitor the status of the refrigerator so as to provide a display of such as a warning to the homeowner. Further, some electronic controls provide for the inputting of electronic commands so as to alter the operating parameters of the refrigerator.

Commonly, prior art refrigerators that have electronic controls have mounted the control board and the visual display as part of or proximate with a through-the-door ice and water dispenser on the freezer door. This arrangement, however, has a number of disadvantages. First, because the through-the-door dispenser is at a height convenient for dispensing ice and water into a glass, it is generally below eye level for most operators, and this makes it difficult to read the electronic display. Second, because the low voltage electronic control panel is positioned adjacent to the high voltage components of the ice and water dispenser, it is subject to electrical interference. Third, if the electronic control is also to be used for refrigerator models that do not have a through-the-door dispenser, different assembly parts would be required for the different models. In other words, it would be desirable to have a mounting for an electronic control that could be used for all models so as to reduce the number of manufactured parts.

SUMMARY OF THE INVENTION

It is an object of the invention to provide improved apparatus for mounting an electronic control board and display in the door of a refrigerator.

It is a further object that the electronic control board comprise only low voltage Class II circuitry, and that it be mounted in the refrigerator door so that if the refrigerator also has a through-the-door ice and water dispenser in the freezer door, the control board will be remote from the high voltage components of the dispenser that could cause electrical interference.

It is also an object to provide a control panel that is at eye level. It is a further object that the control panel be part of or integrally formed with decorative door trim.

It is a further object to provide a compartment within the refrigerator door for mounting the control board, which compartment can be accessed through an aperture in the door for easily inserting and removing the control board from the front of the door. It is also an object to provide an aperture that is relatively thin laterally so that it can be covered by a relatively thin vertical strip of decorative trim. Another object is to provide a control board mounting assembly that can easily and readily be fabricated, and provides positive alignment between a display on the control board and a window in the control panel. That is, with a minimum of labor, there should be self-alignment of the assembly parts such that the display is centered in the window of the graphics overlay of the control panel.

It is a further object to provide a flame barrier between the control board and the control panel while also providing reenforcement of the door panel proximate the aperture so as to prevent oil canning of the door panel.

Still another object is to provide an airtight seal so that moisture is prevented from passing through the aperture to the inside of the door.

These and other objects and advantages are provided in accordance with the invention that includes the combination of a refrigerator door having a front panel with an aperture, a housing positioned behind the panel within the door surrounding the aperture so as to provide a compartment within the door accessible through the aperture. The panel has at least one locator hole adjacent to the aperture and the housing means comprises a locator pin extending through the locator hole in the panel for aligning the housing with respect to the panel and the aperture. The combination also includes an electronic control board insertable through the aperture and removably mounted with predetermined alignment to the housing within the compartment with the electronic control board having a forward facing display. A control panel for the electronic control board comprises a plurality of switches and a window for viewing the forward facing visual display. Means are provided for mounting the control panel over the aperture such that the window has a predetermined alignment with respect to the visual display. In accordance with the invention, apparatus is provided for easily and readily fabricating the refrigerator door to include an electronic control board that has a display that is self-aligned to the window of the control panel that is part of the decorative trim of the refrigerator door. It may be preferable that the mounting means comprise a mounting bracket that has at least one locator hole corresponding to and receiving the locator pin of the housing as it extends through the locator hole in the panel. Accordingly, there is self-alignment of the parts from front to back so that the display is centered in the window of the control panel. Because the relatively narrow trim covers the aperture in the door, it may be preferable that the compartment behind the aperture be substantially wider than the aperture so as to receive the control board, and that the control board be inserted edge first. It may also be preferable that the mounting means further comprise at least one tab extending into the compartment through the aperture and that the tab have a platform for providing an additional mounting surface for the control board.

The invention may also be practiced by the combination of a refrigerator door having a front panel with an aperture, means for forming a compartment within the door accessible through the aperture, the forming means comprising a tub mounted behind the panel and surrounding the aperture, an electronic control board mounted in the compartment, the control board being removeable and insertable into the compartment through the aperture, and means for providing a flame barrier for the aperture and for preventing oil canning of the door adjacent the aperture, the providing and preventing means comprising a plate with a lever extending from one edge, the plate being attached to the panel substantially covering the aperture, the lever being seated against a peripheral portion of the aperture on the backside of the panel so as to prevent the peripheral portion from bending. It may be preferable that the lever be a U-shaped channel. It may also be preferable that the combination include a control panel and a control panel mounting bracket, and that gaskets be provided so as to prevent moisture from passing through the aperture to the inside of the door.

BRIEF DESCRIPTION OF THE DRAWINGS

The foregoing objects and advantages may be more fully understood by reading the description of the preferred embodiment with reference to the drawings wherein.

DESCRIPTION OF THE PREFERRED EMBODIMENTS

Figure 1:
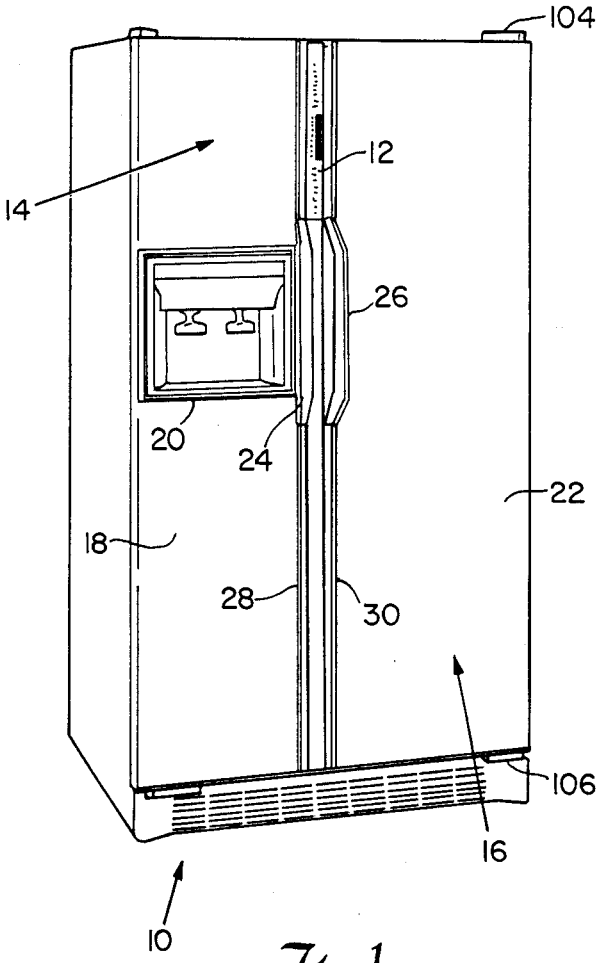
FIG. 1 is a perspective view of a refrigerator including an electronic control with a control panel.

Referring to FIG. 1, side-by-side refrigerator 10 is shown to include an electronic control panel 12. Although the invention could be used to advantage with refrigerators other than so-called side-by-side models, here the freezer section 14 or freezer is located on one side and the refrigerated food section 16 or refrigerator is located on the other side. Freezer 14 has a door 18 which includes an ice and water dispenser 20. Door 18 and door 22 of refrigerated food section 16 have respective handles 24 and 26. Both doors 18 and 22 have respective trim strips 28 and 30 or trim members that run vertically along the respective door edges so as to enhance the aesthetics of the refrigerator 10. Electronic control panel 12 is part of or an extension of trim strip 30 of door 22.

Figure 2:
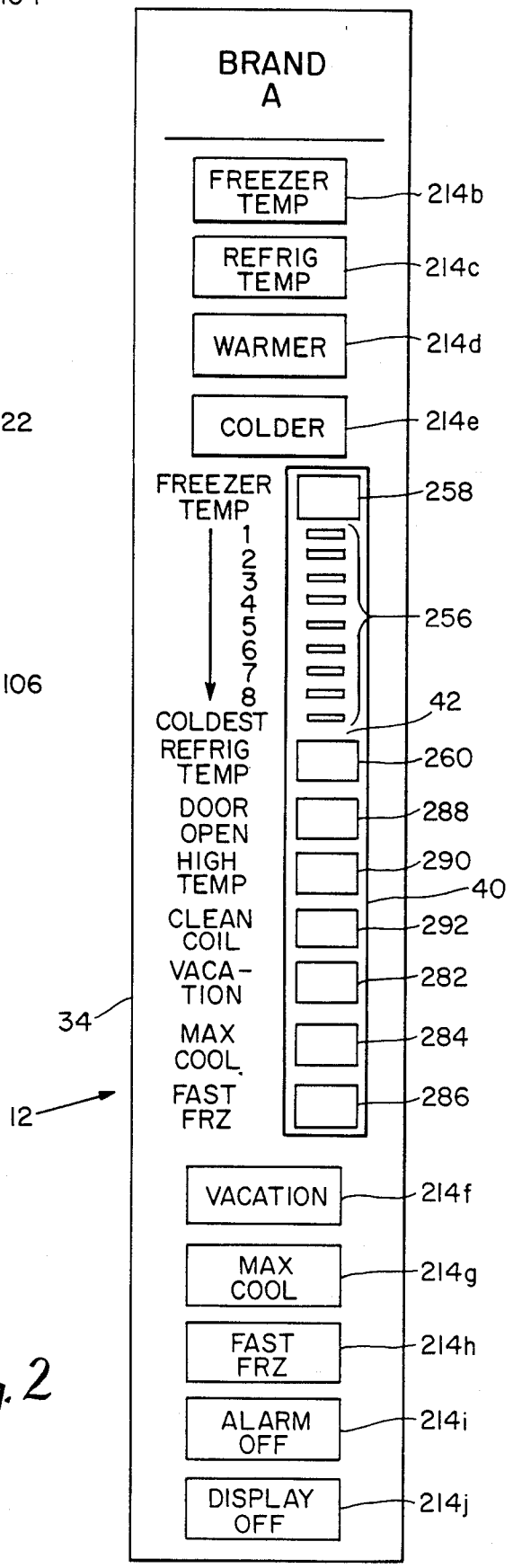
FIG. 2 is an expanded view of the electronic control panel of FIG. 1.

Referring to FIG. 2, an expanded view of the electronic control panel 12 is shown. As is conventional, electronic control panel 12 has a plurality of switches 212*a–j* (FIG. 4) that are located by corresponding touch or key pads 214*b–j* on a graphics overlay 34. Graphics overlay 34 also has a window 40 through which the visual display 42 (FIG. 3) of the electronic control board 36 can be viewed. The specific functions executed in response to the respective key pads 214*b–j* will be described in detail later herein.

Figure 3:
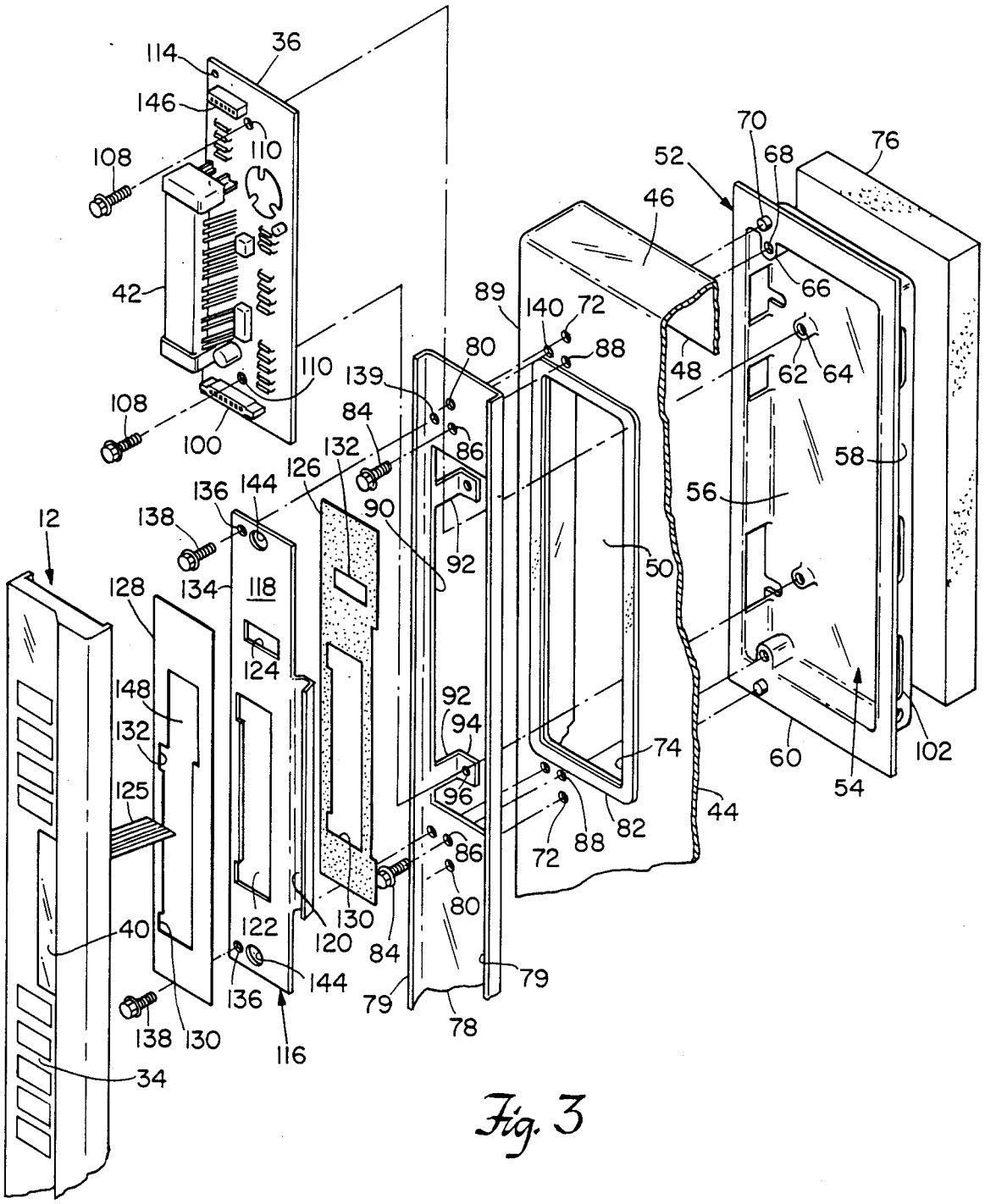
FIG. 3 is an exploded view of the parts used for mounting the electronic control into the refrigerator door.

Referring to FIG. 3, an exploded view of the assembly used to mount the electronic control board 36 in door 22 is shown. Door 22 has a front panel 44, a peripheral edge 46 of predetermined depth such as, for example, 1.5 inches, and an inwardly directed flange 48. As shown, door 22 has a vertically elongated aperture 50 adjacent to the upper-left corner. As will be described later herein, vertical trim strip 30 including electronic control panel 12 covers over aperture 50. Accordingly, the width of aperture 50 is constrained to be relatively narrow such as, for example, 1.5 inches. The height of aperture 50 is not so constrained and accordingly may preferably be 9 or 10 inches. Tub 52 forms a compartment 54 inside of door 22 in which electronic control board 36 is subsequently mounted. Tub 52 or housing, which is a flame rated plastic molded part, includes a bottom 56, sidewalls 58, and an outwardly extending flange 60 or rim. Typical dimensions of compartment 54 may be 11.25"H×3.25"W×¾"D making it wider than aperture 50 through which electronic control board 36 is inserted. That is, the lateral width of electronic control board 36 may perferably be wider than aperture 50, but compartment 54 is made wide enough so as to suitably mount electronic control board 36 therein. Bottom 56 has raised bosses 62 with screw holes 64 which, as it will be described, are used for mounting electronic control board 36 in compartment 54 spaced from bottom 56. Projecting into compartment 54 from top and bottom sidewalls 58 are respective bosses 66 with screw holes 68. Also, locator pins 70 project forwardly from top and bottom flanges 60 of tub 52. Locator pins 70 and bosses 66 are not centered on tub 52, but rather are located closer to the left side such as, for example, spaced approximately ¾" therefrom.

In fabrication, tub 52 is inserted inside of flange 48 from the backside of panel 44, and pushed laterally to the side and upwardly until locator pins 70 align with and insert into corresponding locator holes 72 in panel 44 above and below aperture 50. In this position, locator pins 70 accurately fix the horizontal and vertical alignment of tub 52 with respect to panel 44. Flange 60 seats flushy against peripheral portions of aperture 50 on the backside of panel 44 and forms compartment 54 that extends laterally from the inside edge 74 of aperture 50, and preferably extends 1.5" to 2" to the right of right edge 74 of aperture 50. In other words, compartment 54 formed behind panel 44 is laterally larger than aperture 50 and extends to the right beyond the right edge 74 of aperture 50. As will be apparent later herein, compartment 50 is wide enough so as to house control board 36. Next, a slab 76 of rigid polyurethane foam approximately the same size as tub 52 is inserted between the back of tub 52 and flange 48 so as to hold tub 52 temporarily in place during assembly. The thickness of slab 76 is approximately the difference between the depth of peripheral edge 46 of door 22 and the depth of tub 52 so that flange 48 holds one side and the top of slab 76 and tub 52 in an interference or friction fit. For example, if peripheral edge 46 is 1 ½ and tub has a depth of 1", slab would have a thickness of approximately ½".

Trim retainer 78 is a vertically elongated trim mounting bracket that is affixed along the edge of door 22 and its side rails 79 are subsequently used to clip or snap lock trim member 30 in conventional manner. Trim retainer 78 has a pair of locator holes 80 that align with respective locator pins 70 of tub 52 that project forwardly through locator holes 72 of door 22. That is, when trim retainer 78 is initially being seated against the front of panel 44, it is positioned so that locator pins 70 insert through locator holes 80, thereby fixing the vertical and horizontal alignment of trim retainer 78 to panel 44 and tub 52. Before seating trim retainer 78 flushly against the front of panel 44, resilient retainer gasket 82 is positioned so as to surround aperture 50 and be compressed between trim retainer 78 and panel 44. Accordingly, retainer gasket 82, which may preferably be made of polyethylene with pressure sensitive adhesive on both side, provides a substantially airtight seal between trim retainer 78 and front panel 44 so as to prevent moisture from migrating to the inside of door 22. Trim retainer 78 is then secured to panel 44 by driving screws 84 through holes 88 and 86 in trim retainer 78 and panel 44 respectively, and anchoring the screws 84 in screw holes 68 of tub 52. Accordingly trim retainer 78, panel 44, and tub 52 are securely affixed to each other, and the alignment to each other is precisely fixed by locator pins 70. Once the alignment of trim retainer 78 is set, the lower portion of trim retainer 78 may be screwed to panel 44 down along the side 89.

Trim retainer 78 has an aperture 90 that aligns with aperture 50 of panel 44, and a pair of tabs 92 project from the left edge of aperture 90 down through aperture 50 into compartment 54 of tub 52. Each tab 92 has a right angle bend terminating in a lateral platform 94 with a screw hole 96.

Figure 4:
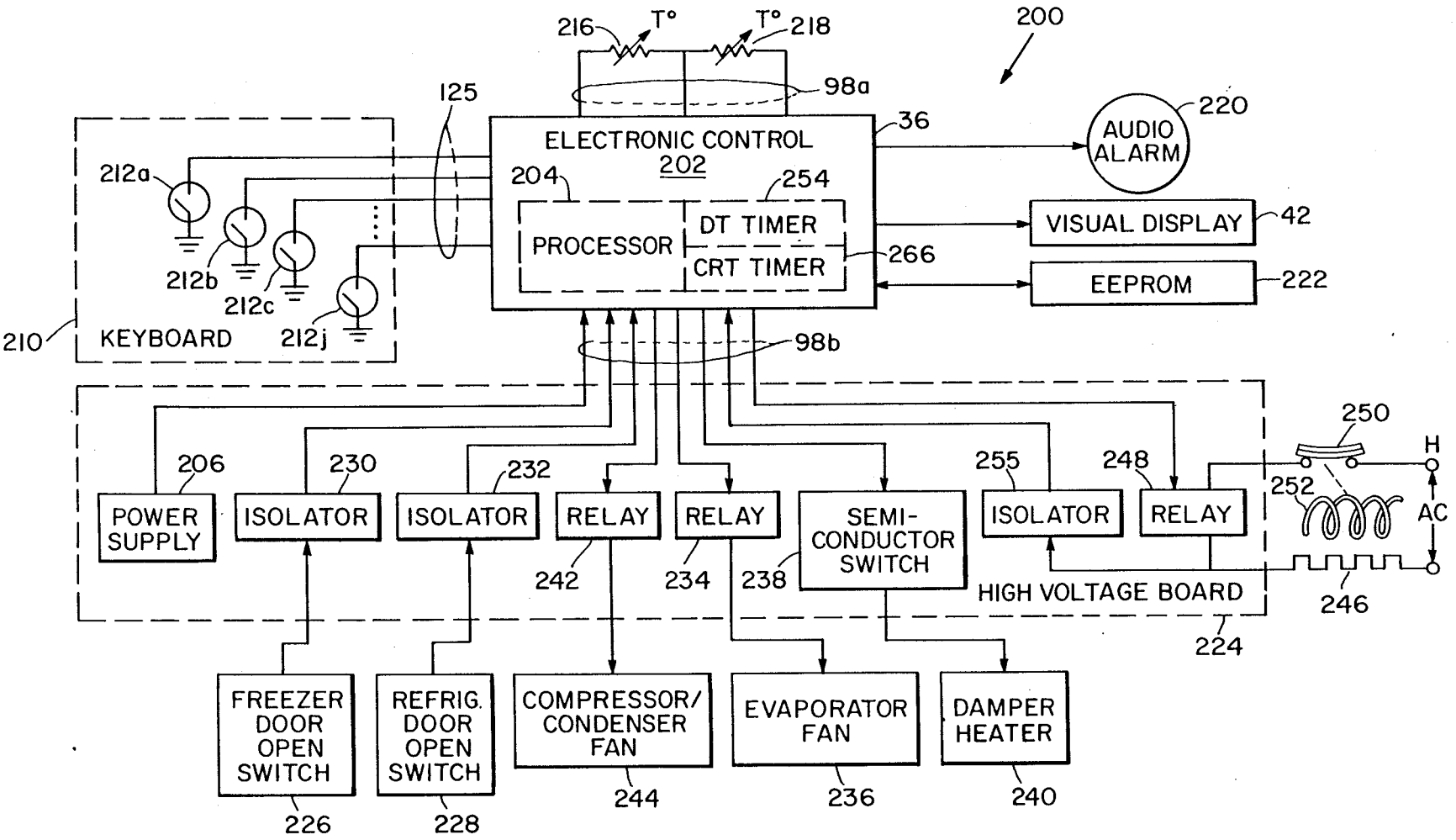
FIG. 4 is a block diagram of the control circuit of the refrigerator.

In the assembly procedure, the electronic circuit control board 36 is next inserted into compartment 54 through aperture 90 and 50. First, however, a cable harness 98*a* and *b* (FIG. 4) is drawn through slot 102 in sidewall 58 of tub 52 and connected to connector 100 of control board 36. Both cable harness sections 98*a* and *b* run along the backside of panel 44 inside of door 22. Section 98*a* is routed through the top hinge 104 of door 22 and includes three leads—one for refrigerator thermister 218, one for freezer thermister 216, and a common as shown in FIG. 4. Section 98*b* is routed through the bottom hinge 106 and is connected to the high voltage board 224 (FIG. 4) located below the refrigerated food section 16. In a preferred embodiment, electronic control board 36 has dimensions of $8\frac{1}{2}'' \times 2\frac{1}{2}''$ making it wider than aperture 50, here $1\frac{1}{2}''$. Accordingly, control board 36 is held in front to back alignment and inserted edge first through apertures 90 and 50. Then, control board 36 is rotated about its vertical axis as it progresses through aperture 50 until it is inside compartment 54 with its right edge extending in compartment 54 to the right or past the right edge 74 of aperture 50. Then, screws 108 are driven through respective holes 110 in control board 36 and anchored into screw holes 64 of bosses 62. In such arrangement, screw bosses 62 space control board 36 from the bottom 56 of tub 52. The left side of circuit board 36 seats down against platforms 94 of tabs 92 thereby further insuring lateral alignment of circuit board 36. Optionally, screws may be inserted through screw holes 114 in control board 36 to aligned screw holes 96 of respective platforms 94. In this arrangement, the position and orientation of control board 36 is fixed with respect to trim retainer 78.

Control board 36 has a visual display 42 preferably of the vacuum fluorescent display type, spaced from control board 36, and due to the heretofore described alignment of control board 36 to trim retainer 78, visual display 42 is accurately and precisely located in and with respect to apertures 50 and 90.

Still referring to FIG. 3, support bracket 116 includes a flat plate 118 having a U-shaped channel 120 or lever extending from a midportion of the right side. The plate 118 has a vertically elongated slot 122 sized to receive visual display 42. Further, plate 118 has a second slot 124 for passing conductor ribbon 125, from electronic control panel 12 to control board 36 as will be described hereinafter. Resilient gaskets 126 and 128 each have adhesive on one side and are affixed to opposite sides of plate 118. Gaskets 126 and 128 each have cut-out portions 130 and 132 conforming to slots 122 and 124.

In assembly, the edge with U-shaped channel 120 or lever is inserted into apertures 90 and 50 and moved rightwardly such that U-shaped channel 120 is positioned behind the right edge 74 of aperture 50. Then, the left edge 134 of plate 118 is moved rearwardly. Notches 144 are provided to receive the heads of screws 84 so that plate 118 can be positioned flushly against trim retainer 78. As the left edge 134 of plate 118 is moved forwardly, U-shaped channel 120 or lever moves forwardly until it seats against the right backside portion of panel 44 peripheral to aperture 50. The presence of lever 120 behind panel 44 prevents oil canning of panel 44 adjacent to aperture 50. In such position, screws 138 are driven into respective holes 136 and 139 and are anchored in screw holes 140 of panel 44. Screws 138 are tightened so that trim retainer 78 and gasket 126 are tightly sandwiched between support bracket 116 and panel 44. As a result, an airtight seal is formed around the edges of aperture 50 so as to prevent moisture from leaking to the inside of the door 22. With such an arrangement, visual display 42 is precisely aligned in slot 122. The alignment is precisely fixed because the tub 52 and thus the control board 36 are precisely located with respect to panel 44, as are the trim retainer 78 and support bracket 116. In addition to providing a sandwiched seal to make the edge of aperture 50 airtight, and also preventing panel 44 from oil canning, support bracket 116 serves an additional function. That is, plate 118 of support bracket 116 also provides a flame barrier between control board 36 and control panel 12 which may not necessarily be a flame rated part. In other words, control board 36 is completely enclosed by support bracket 116 which is metal and tub 52 which is a flame rated part.

In the next step of assembly, conductor ribbon 125 is inserted through slot 124 and connected to ribbon connector 146. Then, control panel 12 is snapped to trim retainer 78 in conventional manner such that control panel 12 covers trim retainer 78. In the preferred embodiment, trim retainer 78 has side rails 79 and control panel 12 has integrally formed clips (not shown) that snap over the outside of rails 79.

The graphics overlay 34 of control panel 12 has a transparent window 40 that aligns precisely over visual display 42 such that visual display 42 can easily be viewed through control panel 12. More specifically, control panel 12 is precisely located both vertically and horizontally with respect to trim retainer 78 which, as described heretofore, is precisely located with respect to visual display 42. Accordingly, the above described arrangement of parts guarantees the centering of visual display 42 with respect to window 40 in the graphics overlay 34. As will be described, control panel 12 includes keyboard 210 (FIG. 4) that has membrane switches 212*a–j* that are interconnected to conductor ribbon 125 and a graphics overlay 34 that includes labeled touch pads or key pads 214*b–j* that identify the location of membrane switches 212*b–j*. The portion 148 of gasket 128 that aligns between slots 122 and 124 is cut out so as to provide a space between control panel 12 and support bracket 116 in which conductor ribbon 125 is routed when control panel 12 is tightly affixed over support bracket 116. Gasket 128, however, has a continuous outer perimeter which is compressed between control panel 12 and support bracket 116, thereby providing an airtight seal. Accordingly, moisture is prevented from migrating to the inside of door 22 through aperture 50.

Door 22 is then filled with fiberglass insulation (not shown) and the inner liner (not shown) is installed. The door is then ready for hanging on refrigerator 10. In an alternate embodiment, door 22 could be foamed-in-place.

Referring to FIG. 4, the control circuit 200 for refrigerator 10 includes electronic control 202 which is mounted on control board 36 in door 22. Electronic control 202 includes processor 204 which preferably is a microcomputer that functions as a digital microprocessor and is programmed in accordance with well-known principles so as to execute the operational functions to be described subsequently herein. Control 202 also includes conventional circuits that are used to interface the various blocks and devices as shown in FIG. 4. Control 202 is a low voltage device and receives power from power supply 206 through cable harness 98*b*.

Keyboard 210 or switchboard of control panel 12 includes a plurality of switches 212*a–j* that are connected to input/output ports of processor 204 so that processor 204 will be able to recognize when any one of switches 212*a–j* has been pressed to its closed position. Preferably, switches 212*a–j* are membrane switches, and switches 212*b–j* are positioned behind respective key pads 214*b–j* of graphics overlay 34 (FIG. 2) which is a flexible face plate. As shown, conductor ribbon 125 interconnects keyboard 210 with control 202.

Freezer thermister 216 and refrigerator thermister 218 are suitably positioned in the freezer section 14 and refrigerated food section 16, respectively. As is well known, the resistances of thermisters 216 and 218 change as a function of temperature, and electronic control 202 senses these resistances so as to determine the temperatures inside the freezer section 14 and the refrigerated food section 16. Audio alarm 220 is mounted on control board 36, and is used by control 202 to give audio warnings to the operator. As described heretofore, visual display 42 which preferably is a vacuum fluorescent display, is mounted to control board 36 and is spaced therefrom. Visual display 42 is visible through window 40 of graphics overlay 34. EEPROM 222 is also mounted on control board 36 and, as will be described subsequently, is used to store programmable parameters of refrigerator 10.

High voltage board 224 is remotely located from electronic control 202 under the refrigerated food section 16, and the two are interconnected by cable harness 98*b* through which electronic control 202 receives various inputs and transmits various control signals. For example, freezer door open switch 226 and refrigerator door open switch 228 provide the open status of freezer door 18 and refrigerator door 22 to processor 204 through respective isolators 230 and 232. That is, processor 204 senses whether either door 18 or 22 is left open or ajar. Further, in response to a refrigerator cut-in temperature as sensed by refrigerator thermister 218, processor 204 controls relay 234 to turn on the evaporator fan 236 and also closes semiconductor switch 238 so as to turn on damper heater 240 and open the damper. Also, in response to a freezer cut-in temperature as sensed by thermister 216, processor 204 closes relays 242 and 234 so as to activate the compressor/condenser fan 244 and evaporator fan 236.

Figure 5:
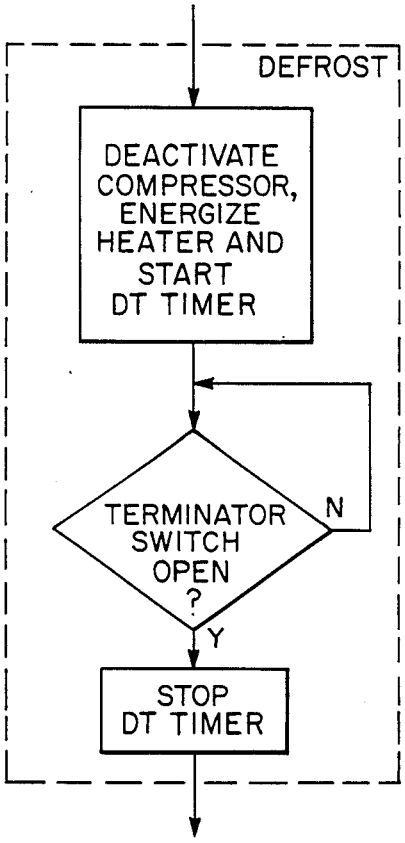
FIG. 5 is a flow diagram of a defrost cycle.

With reference to FIG. 5, processor 204 also controls defrost cycles. More specifically, processor 204 will DEACTIVATE COMPRESSOR, ENERGIZE HEATER AND START DT TIMER in order to initiate a defrost cycle. That is, after compressor 244 is deactivated, evaporator heater 246 is energized by closing relay 248. This connects 120 volts AC across the series of evaporator heater 246 and terminator switch 250 which is a temperature sensitive bimetallic switch. Accordingly, the evaporator heater 246 which is coupled to the evaporator 252 melts the ice on evaporator 252. During the defrost cycle, processor 204 continuously monitors the output of isolator 255 to determine if TERMINATOR SWITCH OPEN? More specifically, when the ice or frost is gone from evaporator 252, the evaporator 252 starts to heat up until it raises to a predetermined temperature at which defrost terminator switch 250 opens up thereby breaking the current flow through heater 246. Isolator 255 provides processor 204 with a signal indicating when current stops flowing through heater 246. Thus, isolator 255 provides an indication of when terminator switch 250 has opened thereby indicating that the defrost cycle has terminated. In response to terminator switch 250 opening, processor 204 will open relay 248 and STOP DT TIMER. More specifically, processor 204 starts DT TIMER 254 running when the heater 246 is energized and stops DT TIMER 254 when terminator switch 250 opens and thereby obtains a measure of the defrost time DT that is related to the amount of ice or frost that collected on evaporator 252.

Referring again to FIG. 2 and also to FIG. 4, the operation of electronic control 202 will be further described with reference to control panel 12. The enable switch 212*a* or key is used to enable all of the other keys 212*b–j* with the exception of the ALARM OFF switch 212*i* or key which is always enabled. That is, unless the enable switch 212*a* is first depressed, processor 204 will not accept command inputs from the operator. More specifically, with reference to FIG. 7, pressing enable switch 212*a* on keyboard 210 of control panel 12 causes processor 204 to set 10-minute countdown timer 215 which, in turn, enables processor 204 to EXECUTE COMMAND INPUTS. That is, processor 204 will receive and execute command inputs from switches 212*b–h* and *j* when timer 215 is counting; otherwise, the command inputs will not be accepted. Processor also monitors to see if there is a COMMAND INPUT? and, anytime there is, 10-minute countdown timer 215 is reset. Accordingly, once enable switch 212*a* is pressed, all of the other switches 212*b–h* and *j* remain active for operator input commands for a period of 10 minutes from the time the last switch 212*a–j* was pressed. In other words, once the input of commands is enabled by enable switch 212*a*, it remains enabled until switches 212*a–j* are inactive for 10 continuous minutes. Extending the 10 minute window of enablement from the time any switch 212*a–j* has been pressed permits lengthy instruction sessions both in the home and in the showroom when a sales person is demonstrating the input command feature. It could be confusing if processor 204 went into a disenabled state during a training session. Once there has been 10 minutes of switch inactivity and 10 minute countdown timer 215 has timed out thereby removing the enable for command inputs, timer 215 can only be set again by enable switch 212*a*; that is, timer 215 will not be reset by pressing switches 212*b–j* because these commands are enabled only when timer 215 is counting down.

Figure 7:
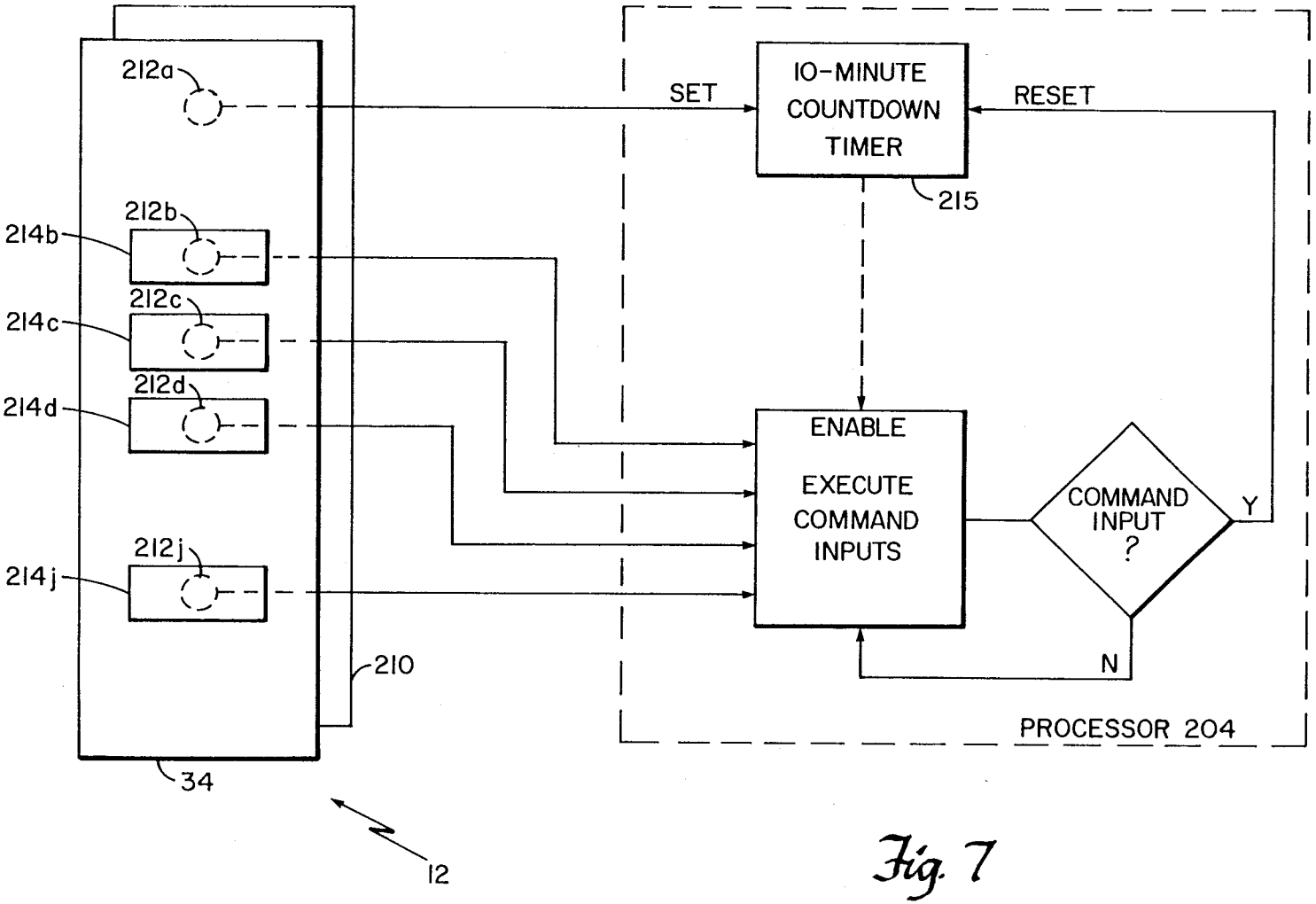
FIG. 7 is a diagram depicting the inputting of operational commands.

Still referring to FIG. 7, keyboard switches 212*b–j* have corresponding indicia of key pads 214*b–j* or touch pads on graphics overlay 34 so as to indicate where to press in order to activate the respective switches 212*b–j* and functions. However, enable switch 212*a* has no corresponding indicia on graphics overlay 34 to locate it. In other words, the location or even the existence of the enable switch 212*a* is not readily apparent to the uninformed user. This limits the inputting of commands to those users who are authorized, and avoids inadvertent or unintentional tampering by others such as by children. The location of enable switch 212a may be indicated by some unrelated symbol which is not conventionally identifiable as a key pad; in FIG. 2, the unrelated symbol in BRAND A.

In the normal mode of operation, the temperature level portion 256 of visual display 42 indicates the present temperature setting of either the freezer section 14 or the refrigerated food section 16. The freezer 14 or frozen section and the refrigerator 16 or fresh food section can be set to any one of nine possible temperature levels from 1–9 (coldest) as shown in the table below:

TABLE

| | FRESH FOOD | | FROZEN FOOD | |
|---|---|---|---|---|
| LEVEL | CUT-IN °F. | CUT-OUT °F. | CUT-IN °F. | CUT-OUT °F. |
| 1 | 48 | 43 | 14 | 2 |
| 2 | 46 | 41 | 12 | 0 |
| 3 | 44 | 39 | 10 | −2 |
| 4 | 43 | 38 | 9 | −3 |
| 5 | 42 | 37 | 8 | −4 |
| 6 | 41 | 36 | 7 | −5 |
| 7 | 40 | 35 | 6 | −6 |
| 8 | 38 | 33 | 4 | −8 |
| 9 | 36 | 31 | 2 | −10 |
| FAST FRZ | | | 2 | −10 |
| MAX COOL | 36 | 31 | | |

For example, if the freezer 14 is set at level 7, then processor 204 will cause the compressor 244 to cut in or be activated when the temperature of the freezer section 14 as sensed by thermister 216 is +6° F., and processor 204 will cause compressor 244 to be cut out or deactivated when the temperature drops to −6° F. FREEZER TEMP light 258 and REFRIG TEMP light 260 indicate whether the temperature level portion 256 is displaying the freezer 14 or refrigerator 16 temperature. To raise the setting temperature of the displayed section (freezer or refrigerator), the WARMER key pad 214d is pressed and the level as indicated by the temperature level portion 256 is raised one step at a time. If WARMER key pad 214d is continuely pressed, the setting will sequence through the levels at an accelerated rate. Conversely, the COLDER key pad 214e is used to change the temperature setting to a lower temperature. FREEZER TEMP key pad 214b and REFRIG TEMP key pad 214c are used to change the parameter displayed in temperature level portion 256 and the command input of WARMER and COLDER key pads 214d and *e*, respectively, from refrigerator to freezer and vice versa.

Figure 6:
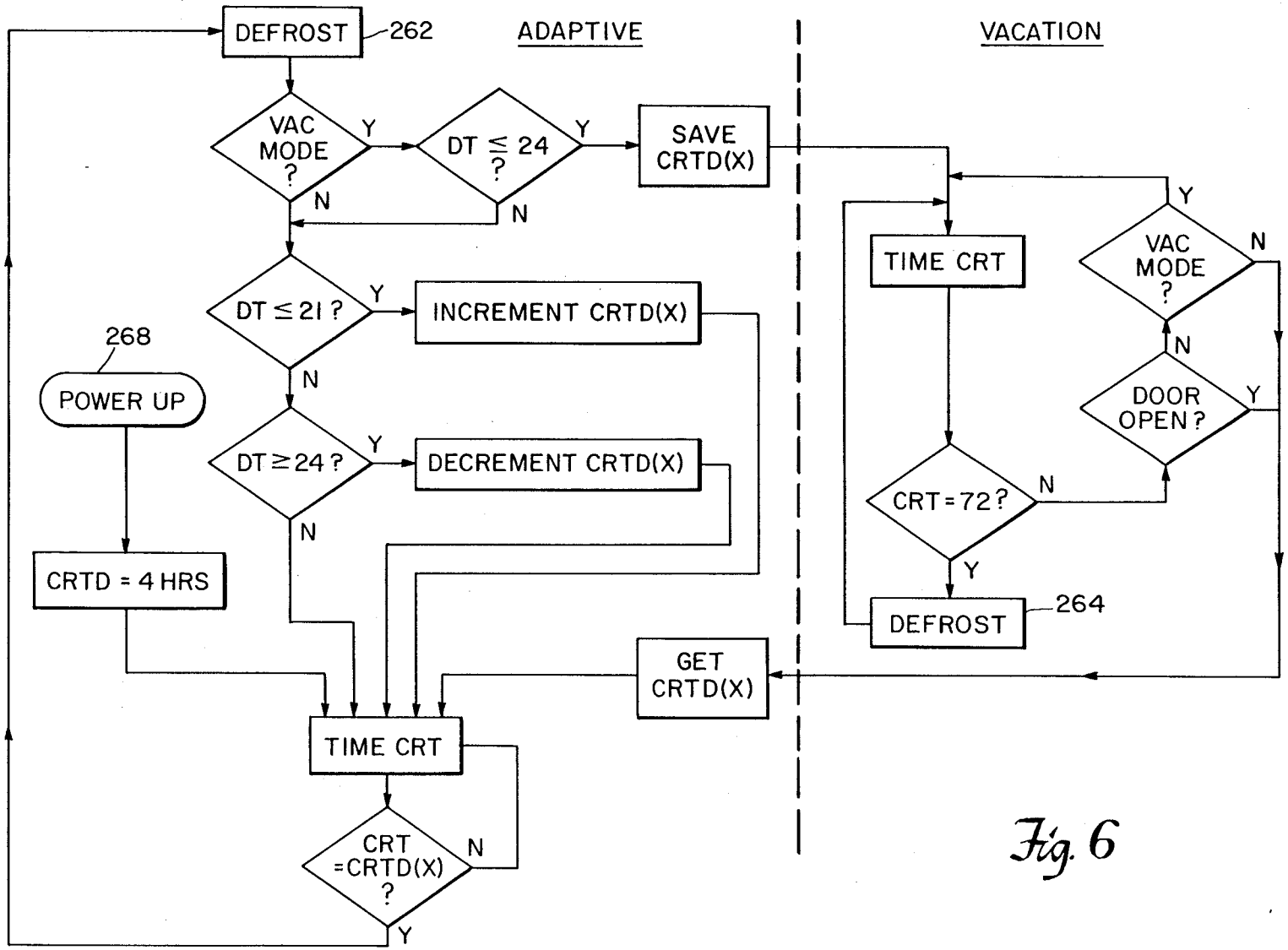
FIG. 6 is a flow diagram of the adaptive and vacation modes of determining the intervals between defrost cycles.

Still referring to FIG. 2, VACATION key pad 214f is used to increase the number of compressor run time hours between defrost cycles, thereby providing operation that is more advantageous and economical when the refrigerator is not being used for extended periods of time. First, however, the normal or adaptive mode of determining the interval between defrost cycles will be described with referenced to FIG. 6. DEFROST blocks 262 and 264 indicate the execution of a defrost cycle as described with reference to FIG. 5. That is, after a defrost cycle is initiated, the evaporator heater 246 is energized, and DT timer 254 is used to measure the on time of the heater 246 until the terminator switch 250 opens thereby terminating the defrost cycle. With the exception of DEFROST blocks 262 and 264, the other steps or blocks in FIG. 6 are used to determine how many compressor run time hours will elapse between defrost cycles. In the adaptive or normal defrost mode, a defrost cycle is initiated after a predetermined number of compressor run hours has elapsed from the last defrost cycle, and the number of hours changes or adapts depending upon the recent history of how long it takes for the defrost terminator switch 250 to open after the defrost heater 246 has been energized. In other words, the time interval DT to defrost is related to the amount of ice collected on evaporator 252, and the selected number of compressor run hours before the next defrost cycle is inversely related thereto. If there was a lot of ice on evaporator 252, then it is desirable to defrost again relatively soon; on the other hand, if there was little ice, then it is desirable to wait a relatively long time. Compressor run time CRT is the parameter measured or timed between defrost cycles, and CRT is accumulated in CRT timer 266. In other words, CRT timer 266 runs if and only if compressor 244 is activated.

In the normal or adaptive defrost mode of operation, the compressor run time between defrost (CRTD) will be one of three values: CRTD (1)=8 hours; CRTD (2)=12 hours; and CRTD (3)=16 hours. After DEFROST block 262 and assuming VACation MODE has not been selected, processor 204 checks to see if the defrost time DT for the last defrost was LO indicating a small accumulation of ice. That is, if DT<21) minutes, then processor 204 will INCREMENT CRTD(X) to the next higher value unless it is already at the maximum CRTD (3). Alternatively, processor 204 checks to see if the defrost time DT for the last defrost was HI indicating a large defrost load. That is, if DT>24 minutes, then processor 204 will DECREMENT CRTD(X) to the next lower value unless it is already at the minimum CRTD (1). If the defrost time DT for the last defrost was intermediate (e.g. 21 <DT<24), then CRTD(X) is left unchanged. After CRTD(X) is set (i.e. 8, 12, or 16 hours), processor 204 will TIME CRT; that is, processor 204 will keep a running total of the compressor run time hours in CRT timer 266. Also, processor 204 monitors CRT timer 266 to see if CRT=CRTD(X)? When it is, another defrost cycle is initiated. In summary, CRTD(X) is updated according to an inverse relationship with the defrost time DT after each DEFROST 262, and then the compressor run time hours are timed for the selected number of hours (i.e. 8, 12, 16 hours) and then the next defrost cycle is executed. After POWER UP block 268, processor 204 initially sets CRTD=4 hours.

If VACATION key pad 214f is pressed, VACATION light 282 is illuminated, but CRTD(X) is initially left unchanged; the next DEFROST 262 cycle occurs as previously scheduled in accordance with the normal or adaptive defrost mode as it existed prior to VACATION key pad 214f being pressed. Then, after the next DEFROST 262, the program branches at VAC MODE? and processor 204 checks to see if DT≦24?. If DT is not less than 24 minutes, it may be indicative that there is a component failure, malfunction, and the compressor run time between defrost is limited to the normal mode selections of CRTD(X) (i.e. 8, 12, or 16 hours) until a DEFROST 262 is executed in 24 minutes or less. Only then is a new energy saving CRTD established. First, however, processor 204 will SAVE CRTD(X) so that it can be used after returning from the vacation mode of defrost to the normal mode. Once in the vacation mode of defrosting, processor 204 will TIME CRT. That is, the compressor run time is accumulated in CRT timer 266 until the condition of CRT=72? is satisfied. Then, DEFROST 264 is executed and another 72 hours of compress run time elapses before another DEFROST 264 is executed; the elapsed hours are not dependent on DT while monitoring to see if CRT=72?. Processor 204 also monitors to see if DOOR OPEN? or VAC MODE? That is, if either door 18 or 22 is opened indicating use of refrigerator 10, the defrost mode automatically returns from the fixed 72 hours if compressor run time to the adaptive or normal mode where the selected compressor run hours are inversely related to DT. Further, the vacation mode is exited if the VACATION key pad **214*f* is pressed so as to provide an interrupt to processor 204. Upon exiting the vacation mode, processor 204 will GET CRTD(X) that was stored. If CRT timer 266 already passed CRTD(X) in the vacation mode, DEFROST 262 will immediately be executed. Otherwise, processor will wait until CRT=CRTD(X). The VACATION light 282** is extinguished when leaving the vacation mode.

MAX COOL key pad **214*g* is used to put processor 204 into the MAX COOL mode wherein the refrigerator temperature setting will be set at level 9 or its coldest setting as shown in the above table for 10 hours or until the MAX COOL key pad 214*g* is pressed again. This mode is generally used when a large load of food has been added to refrigerator section 16. While in MAX COOL mode, the MAX COOL light 284** is illuminated.

FAST FRZ key pad **214*h* is used to put the processor 204 into the FAST FRZ mode wherein the freezer temperature setting will be set to level 9 or the coldest setting as shown in the above table for 24 hours or until the FAST FRZ key pad 214*h* is pressed again. This mode is generally used when a large load of food has been added to freezer section 14. While in the FAST FRZ mode, the FAST FRZ light 286** is illuminated.

As described earlier, processor 204 monitors whether doors 18 and 22 are open. If either is open, processor 204 illuminates DOOR OPEN light 288. If either door is continuously open for 3 minutes, DOOR OPEN light 288 is flashed and audio alarm 220 is energized. Closing the open door 18 or 22 will turn off the audio alarm 220 and DOOR OPEN light 288. ALARM OFF key pad **214*i* can be used to turn off the audio alarm 220. Processor 204 illuminates HIGH TEMP light 290 if the temperature of freezer 14 goes above 15° F. for a period of 2 continuous hours or refrigerator 16 goes above 60° F. for a period of 2 continuous hours. Under such circumstances, the FEEZER TEMP light 258 or REFRIG TEMP light 260 flashes on and off to indicate which has the high temperature, and also audio alarm 220 will be energized. ALARM OFF key pad 214*i* can be used to turn off the alarm. Processor 204 illuminates the CLEAN COIL light 292 after 3 months of time. The light is turned off automatically after 72 hours or upon pressing the ALARM OFF key pad 214*i***.

As described heretofore, ALARM OFF key pad **214*i* is used to turn off the alarms for HIGH TEMP and CLEAN COIL. Also, if ALARM OFF key pad 214*i*** is pressed for 3 seconds, it will cause the door open audio alarm to toggle to an inoperative state.

DISPLAY OFF key pad **214*j* is used to turn the temperature level portion 256 of visual display 42** off.

Control panel 12 can also be used to reprogram the operation of processor 204. However, as will become apparent, the program ability feature is only for those with special training such as service technicians, and therefore access into the programming mode requires a highly unusual sequence of operator inputs that would only be known to those with prior instruction. As an example, access is here gained by pressing enable key **212*a*, opening a door 18 or 22, and then pressing the sequence of VACATION key pad 214*f*, MAX COOL 214*g*, FAST FRZ key pad 214*h*, MAX COOL key pad 214*g*, and FAST FRZ key pad 214*h* within 5 seconds. There are two possible programming modes—Mode A and Mode B—that can be cycled back and forth by pressing enable switch 212*a*. In Mode A, processor 204 sets the temperature level portion 256 so as to indicate the temperature read by freezer thermister 216 if the FREEZER TEMP light 258 is on, and read by the refrigerator thermister 218 if the REFRIG TEMP light 260 is on. To go from reading one to reading the other, the FREEZER TEMP key pad 214*b* or REFRIG TEMP key pad 214*c* is pushed as appropriate. The actual read temperature is displayed by indicating the tens digit in BCD using the top four temperature levels (1–4), and the ones digit in BCD using levels 5–8. The coldest level or level 9 is used to indicate whether the temperature is above or below 0° F. For example, when the coldest level is illuminated, it indicates that the temperature read by levels 1–8 is negative. It is noted that by displaying the temperature setting rather than the actual sensed temperature in the normal mode of operation (i.e. not program mode), concern and confusion, and therefore unnecessary service calls may be avoided. In this programming mode, however, the service technician may want to know the sensed temperature to check respective thermisters 216 and 218** and associated reading circuitry, or to calibrate the relationship between settings and sensed temperature by introducing offsets as will be described subsequently.

To enter program mode B, enable switch **212*a* is pressed and the CLEAN COIL light 292 is extinguished to indicate the passage from mode A. In mode B, operational parameters or variables of processor 204 can be reprogrammed or altered. For example, the frozen food temperatures as shown in the table may be offset. In order to effect this, the operator presses the FREEZER TEMP key pad 214*b*, and then the WARMER key pad 214*d* or COLDER key pad 214*e* are used to alter the offset as displayed in the temperature level portion 256. Here, indicator level 1 indicates a +8° F. offset and indicator level 9 indicates −8° F. offset with 2° F. incremental steps therebetween. The fresh food temperatures as shown in the table may similarly be offset by first pressing the REFRIG TEMP key pad 214*c***.

Further, in mode B, the MAX COOL duration may be altered. In order effect this, the MAX COOL key pad **214*g* is first pressed, and then the WARMER key pad 214*d* and COLDER key pad 214*e* are used to increase or decrease the duration. For example, indicator level 1 here indicates a 6 hour duration and indicator level 9 indicates a 22 hour duration with 2 hour increments therebetween. Similarly, the FAST FRZ duration may be altered by first pressing the FAST FRZ key pad 214*h*. Indicator 1 corresponds to an 8 hour duration while indicator 9 indicates a 40 hour duration with 4 hour incremental steps therebetween. The parameters as input in programming mode B are stored in EEPROM 222** and therefore are available after a power failure.

This concludes the description of the preferred embodiment. However, a reading of it by one skilled in the art will bring to mind many alterations and modifications without departing from the spirit and scope of the invention. Therefore, it is intended that the scope of the invention be limited only by the appended claims.

What is claimed is:

1. In combination:

a refrigerator door having a front panel with an aperture;

a housing positioned behind said panel within said door surrounding said aperture, thereby providing a compartment within said door accessible through said aperture, said panel having at least one locator hole adjacent said aperture, said housing comprising means comprising a locator pin extending through said at least one locator hole in said panel for aligning said housing with respect to said panel and said aperture;

an electronic control board insertable through said aperture and removably mounted with predetermined alignment to said housing within said compartment, said electronic control board having a forward facing visual display;

a control panel for said electronic control board, said control panel comprising a plurality of switches and a window for viewing said forward facing visual display; and means for mounting said control panel over said aperture so that said window has a predetermined alignment with respect to said visual display.

2. The combination recited in claim 1 wherein said mounting means comprises a mounting bracket having at least one locator hole corresponding to and receiving said at least one locator pin of said housing extending through said at least one locator hole of said panel.

3. The combination recited in claim 1 wherein said compartment is wider than said aperture.

4. The combination recited in claim 1 wherein said mounting means further comprises at least one tab extending into said compartment through said aperture, said tab having a platform for mounting said control board.

5. A refrigerator door, comprising:

a front panel with a vertically elongated aperture adjacent to one edge;

a tub positioned behind said panel within said door, said tub having a rim contacting portions of the back of said panel peripherally said around said aperture thereby defining a compartment within said door accessible through said aperture, said panel having a plurality of locator holes adjacent said aperture and said tub having corresponding locator pins respectively inserted through said locator holes of said panel thereby positively fixing the alignment of said tub with respect to said panel and said aperture;

an electronic control board removeably mounted with fixed alignment to said tub within said compartment, said electronic control board having a forward facing visual display;

a control panel mounting bracket affixed to the front of said panel, said bracket having a plurality of locator holes corresponding to and respectively receiving said locator pins of said tub extending forwardly through said locator holes of said panel, thereby positively fixing the alignment of said mounting bracket with respect to said tub and said control board mounted to said tub; and a control panel including a graphics overlay with a window attached to and aligned with said mounting bracket wherein said visual display of said control board is aligned with said window for viewing said visual display therethrough.

6. The refrigerator recited in claim 5 wherein said compartment is wider than said aperture.

7. The refrigerator recited in claim 5 wherein said mounting bracket further comprises at least one tab extending into said compartment through said aperture, said tab having a platform for mounting said control board.

8. The refrigerator recited in claim 5 wherein said mounting bracket extends down along the edge of said door, said refrigerator further including decorative trim mounted to said bracket below said control panel, said trim being vertically aligned with said control panel.

9. The method of fabricating a refrigerator door, comprising the steps of:

providing a front door panel having an aperture with a plurality of locator holes adjacent thereto;

providing a tub with a corresponding plurality of forwardly extending locator pins;

positioning said tub behind said door panel surrounding said aperture and inserting said locator pins respectively through said locator holes of said panel, thereby providing a compartment within said door that is accessible through said aperture and has a predetermined alignment with respect to said door panel;

inserting an electronic control board having a forward facing display into said compartment through said aperture and attaching said control board to said tub, wherein said display has a predetermined alignment with respect to said panel;

mounting a control panel mounting bracket having locator holes to the front of said door panel with said locator pins of said tub extending through said locator holes in said mounting bracket; and removeably attaching a control panel having a window to said control panel mounting bracket over said aperture wherein said window is aligned over said display.

10. In combination:

a refrigerator door having a front panel with an aperture;

means for forming a compartment within said door accessible through said aperture, said forming means comprising a tub mounted behind said panel and surrounding said aperture;

an electronic control board mounted in said compartment, said control board being removeable from and insertable into said compartment through said aperture; and means for providing a flame barrier for said aperture and for preventing oil canning of said door adjacent said aperture, said providing and preventing means comprising a plate with a lever extending from one edge, said plate being attached to said panel substantially covering said aperture, said lever being seated against a peripheral portion of said aperture on the backside of said panel so as to prevent said peripheral portion from bending.

11. The combination recited in claim 10 wherein said lever is a U-shaped channel.

12. The combination recited in claim 10 wherein said control board has a visual display and said plate has a window through which said display is viewed.

13. The combination recited in claim 12 further comprising a control panel and a control panel mounting bracket, said mounting bracket being positioned between said plate and said panel, said mounting bracket having a pair of side rails for snap-locking said control panel to said mounting bracket.

14. The combination recited in claim 13 further comprising a gasket between said mounting bracket and said panel.

15. The combination recited in claim 14 further comprising a first gasket positioned between said mounting bracket and said plate, and a second gasket positioned between said plate and said control panel, said first and second gaskets providing a substantially air tight seal for preventing moisture from entering said door through said aperture.

16. The combination recited in claim 15 further comprising a ribbon conductor interconnected between said control panel and said control board, said plate having an aperture for passing said ribbon conductor.

* * * * *